US007955283B2

(12) United States Patent
Katz et al.

(10) Patent No.: US 7,955,283 B2
(45) **Date of Patent: *Jun. 7, 2011**

(54) SAFETY MECHANISMS FOR BELT CARTRIDGE USED WITH CHEST COMPRESSION DEVICES WITH BREAKABLE LINK

(75) Inventors: Bob H. Katz, Los Gatos, CA (US); Timothy R. Dalbec, Saratoga, CA (US); Gregory W. Hall, Redwood City, CA (US)

(73) Assignee: Zoll Circulation, Inc., Sunnyvale, CA (US)

( * ) Notice: Subject to any disclaimer, the term of this patent is extended or adjusted under 35 U.S.C. 154(b) by 339 days.

This patent is subject to a terminal disclaimer.

(21) Appl. No.: 12/220,938

(22) Filed: Jul. 29, 2008

(65) Prior Publication Data

US 2008/0287841 A1 Nov. 20, 2008

Related U.S. Application Data

(63) Continuation of application No. 10/686,184, filed on Oct. 14, 2003, now Pat. No. 7,404,803.

(51) Int. Cl.
*A61H 31/00* (2006.01)

(52) U.S. Cl. ..... 601/152; 601/DIG. 6; 601/DIG. 20

(58) Field of Classification Search ..... 601/41–44, 601/143–147, 148, 151, 152, DIG. 20, DIG. 6; 602/32–35, 38

See application file for complete search history.

(56) References Cited

U.S. PATENT DOCUMENTS

| | | | | |
|---|---|---|---|---|
| 651,962 | A * | 6/1900 | Boghean | 601/41 |
| 4,004,579 | A * | 1/1977 | Dedo | 601/41 |
| 4,770,164 | A * | 9/1988 | Lach et al. | 601/41 |

FOREIGN PATENT DOCUMENTS

| | | | |
|---|---|---|---|
| JP | 6319791 | A | 11/1994 |
| JP | 2002238930 | A | 8/2002 |
| WO | 9909918 | A1 | 3/1999 |
| WO | 03024336 | A1 | 3/2003 |

* cited by examiner

*Primary Examiner* — Danton DeMille

(74) *Attorney, Agent, or Firm* — K. David Crockett, Esq.; Paul J. Backofen, Esq.; Crockett & Crockett, PC

(57) ABSTRACT

Safety mechanisms for compression belt cartridges used in chest compression devices. The safety mechanisms include a breakable link, liner socks, belt guards and a rapid-release connector. The breakable link ensures that unsafe belt tension will not occur. The liner socks protect the patient from friction and contain the breakable link. The belt guards protect foreign objects from entering the belt drive platform. The rapid-release connector allows the belt to be removed safely even during compressions.

14 Claims, 4 Drawing Sheets

SAFETY MECHANISMS FOR BELT CARTRIDGE USED WITH CHEST COMPRESSION DEVICES WITH BREAKABLE LINK

RELATED APPLICATIONS

This application is a continuation of U.S. Utility application Ser. No. 10/686,184 filed Oct. 14, 2003 now U.S. Pat. No. 7,404,803.

FIELD OF THE INVENTIONS

The inventions described below relate to emergency medical devices and methods and the resuscitation of cardiac arrest patients.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., *Decay In Quality Of Chest Compressions Over Time,* 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45 to 90 minutes) have been reported, with the victims eventually being saved by coronary bypass surgery. See Tovar, et al., *Successful Myocardial Revascularization and Neurologic Recovery,* 22 Texas Heart J. 271 (1995).

In efforts to provide better blood flow and increase the effectiveness of bystander resuscitation efforts, various mechanical devices have been proposed for performing CPR. In one variation of such devices, a belt is placed around the patient's chest and the belt is used to effect chest compressions. Our own patents, Mollenauer et al., Resuscitation device having a motor driven belt to constrict/compress the chest, U.S. Pat. No. 6,142,962 (Nov. 7, 2000); Sherman, et al., CPR Assist Device with Pressure Bladder Feedback, U.S. Pat. No. 6,616,620 (Sep. 9, 2003); Sherman et al., Modular CPR assist device, U.S. Pat. No. 6,066,106 (May 23, 2000); and Sherman et al., Modular CPR assist device, U.S. Pat. No. 6,398,745 (Jun. 4, 2002), and our application Ser. No. 09/866,377 filed on May 25, 2001, show chest compression devices that compress a patient's chest with a belt. Each of these patents is hereby incorporated by reference in their entirety.

Since seconds count during an emergency, any CPR device should be easy to use and facilitate rapid deployment of the device on the patient. Since the forces involved in chest compression are large, a chest compression device should also include safety devices to ensure that the device does not harm the patient or rescuers. Our own devices are easy to deploy quickly, do increase the patient's chances of survival and do include safety features that protect the patient and any rescuers. Nevertheless, a novel compression belt cartridge has been designed to further increase the speed of belt deployment, the ease of use of the device, the ease of maintenance and the safety features of the device.

SUMMARY

The devices and methods shown below provide for a belt cartridge for use in devices that perform chest compressions. The cartridge has a belt, a compression pad attached to the belt, a cover plate through which the belt is threaded, a belt spline for attaching the belt to a drive spool of a belt drive platform, and belt guards rotatably attached to the cover plate. During use, the cover plate and belt guards are removably attached to the housing of the belt drive platform. In turn, the belt extends out of the housing and is secured around the patient. The safety mechanisms include a breakable link, liner socks, belt guards and a rapid-release connector. The breakable link is attached near the transition section of the belt. The breakable link prevents an unsafe amount of tension from developing in the belt by breaking at a pre-selected load threshold.

The liner socks protect the patient from friction and contain the breakable link. The liner socks cover the belt so that the belt slides against the liner socks and not against the patient. If the link breaks, then the link remains inside a sock.

The belt guards protect foreign objects from entering the belt drive platform. Thus, articles of clothing, tools, fingers, other body parts, or other foreign objects are less likely to interfere with the belt drive platform. Similarly, the patient and rescuer are less likely to be injured by the device since the belt guards protect the moving parts of the belt drive platform.

The rapid-release connector allows the belt to be removed safely even during compressions. The rapid release connector is placed on the load distribution sections of the belt. The connector is a combination of hook and loop fasteners and a peg disposed within an eyelet.

DETAILED DESCRIPTION OF THE INVENTIONS

Figure 1:
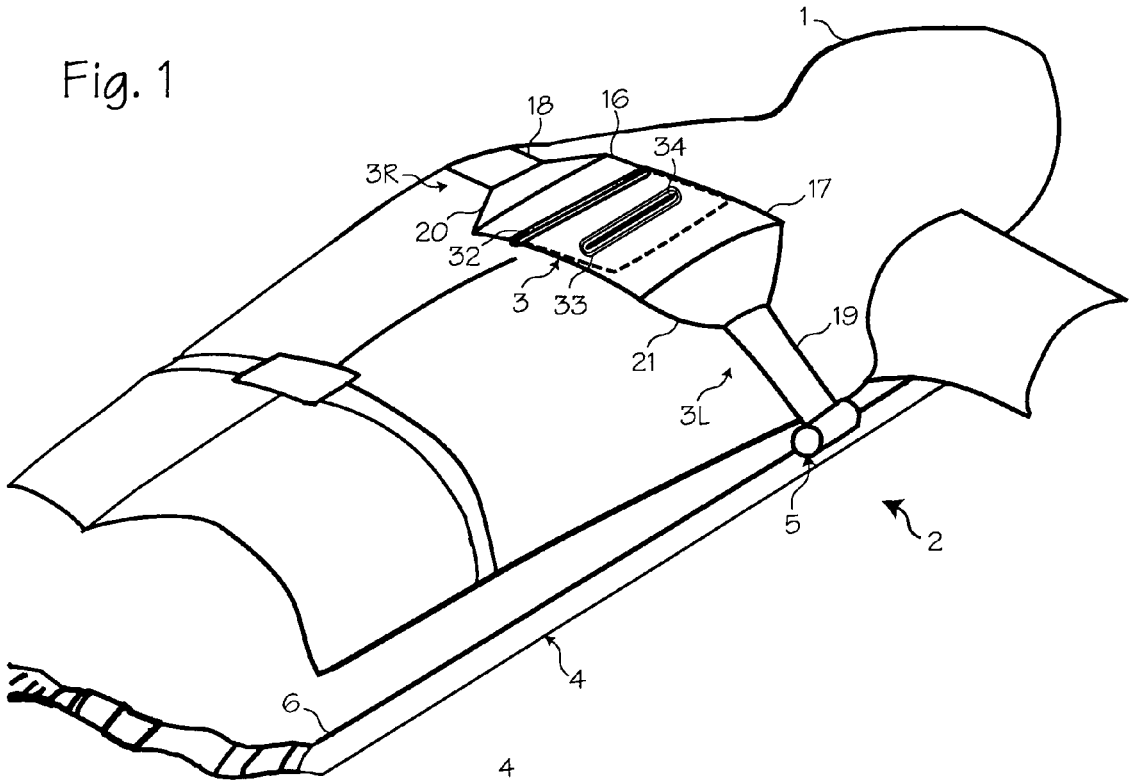
FIG. 1 shows the chest compression belt fitted on a patient.

FIG. 1 shows the chest compression belt fitted on a patient 1. A chest compression device 2 applies compressions with the belt 3, which has a right belt portion 3R and a left belt portion 3L. The chest compression device 2 includes a belt drive platform 4 and a compression belt cartridge 5 (which includes the belt). The belt drive platform includes a housing 6 upon which the patient rests, a means for tightening the belt, a processor and a user interface disposed on the housing. The means for tightening the belt includes a motor, a drive train (clutch, brake and/or gear box) and a drive spool upon which the belt spools during use. Various other mechanisms may be used to tighten the belt, including the mechanisms shown in Lach et al., Resuscitation Method and Apparatus, U.S. Pat. No. 4,774,160 (Sep. 13, 1988) and in Kelly et al., Chest Compression Apparatus for Cardiac Arrest, U.S. Pat. No. 5,738,637 (Apr. 14, 1998). The entirety of these patents is hereby incorporated by reference.

In use, the patient is placed on the housing and the belt is placed under the patient's axilla (armpits), wrapped around the patient's chest, and secured. The means for tightening the belt then tightens the belt repetitively to perform chest compressions.

The compression belt 3 shown in FIG. 1 is provided with a structure that aids in performing compressions effectively and efficiently. Specifically, the belt is shaped like a double-bladed oar. The wider load distribution sections 16 and 17 of the belt are secured to each other over the patient's chest and apply the bulk of the compressive load during use. The narrow pull straps 18 and 19 of the belt are spooled onto the drive spool of the belt drive platform to tighten the belt during use. The trapezoid-shaped transition sections 20 and 21 reinforce the belt and transfer force from the pull straps to the load distribution sections evenly across the width of the load distribution sections. The narrow end of a trapezoid faces the pull strap and the wide end of a trapezoid faces a corresponding load distribution section.

The pull straps 18 and 19 of the belt are narrow so that the chest compression device may perform compressions more efficiently, thus saving battery power and prolonging the ability of the device to perform compressions. The narrow pull straps of the belt reduce the mass of the belt and reduce the torque necessary to tighten the belt around the patient's chest, particularly when the means for tightening the belt tightens the belt by spooling it around a drive spool. In addition, by using narrow pull straps, the belt may fit within a narrow channel beam in the belt drive platform. This reduces the weight and size of the belt drive platform and increases the strength of the platform by allowing a narrower channel beam (see item 45 of FIG. 2) to be used with the platform.

The load distribution sections 16 and 17 of the belt are wider than the pull straps to allow the chest compression device to perform compressions more effectively and more safely. The wider portions of the belt compress more of the chest, increasing blood flow and thus performing compressions more effectively. In addition, the wider portions of the belt allow more force to be applied to the patient by evenly distributing pressure on the patient's chest, thus increasing blood flow while making chest compressions safer for the patient.

The transition sections 20 and 21 of the belt transfer the tension from the pull straps to the load distribution sections and reinforce the belt. Thus, the transition sections narrow along the lateral portion of the belt.

The right load distribution section 16 and left load distribution section 17 of the belt are provided with hook and loop fasteners so that the belt may be secured to the patient's chest. (Securing the right and left load distribution sections to each other secures the belt around the patient's chest.) Preferably, the hook side of the hook and loop fastener is located on the anterior load distribution section of the belt (in this illustration, the left side is anterior to and superficial to the right load distribution section) so that the hooks do not contact carpet or other materials when the belt is open and splayed on the ground, though the hook and loop fasteners may be located anywhere on the load distribution sections of the belt. A handle 32 (more clearly shown in FIG. 2) is provided on the left end of the belt to aid in placing and removing the belt. The handle and user interface are located on the same side of the belt drive platform to make applying and removing the belt an ergonomic motion.

An eyelet 33 is provided in the left load distribution section of the belt and a corresponding registration peg 34 is provided in the right load distribution section of the belt. (The peg, eyelet and hook and loop fasteners may be disposed on either load distribution section.) To secure the belt to the patient, the left load distribution section is laid over the right load distribution section and the eyelet is aligned with the peg. (The peg fits within the eyelet.) The eyelet and peg assist the rescuer to properly register the load distribution sections with respect to each other and the patient, and thereby properly position the belt on the patient. The eyelet and peg are also long relative to the superior/inferior direction of the patient and are located in the center of the assembled load distribution sections. Thus, the eyelet and peg help the rescuer place the center of the load distribution sections over the center of the patient's sternum. In addition, since the right and left load distribution sections tend to pull away from each other when the belt is tensioned, the peg and eyelet further secure the load distribution sections of the belt to each other by resisting shear forces that tend to pull the sections apart.

In addition, the peg and eyelet enable the rescuer to repeatably release the belt and then secure the belt around the patient such that the belt has the same length each time the belt is secured around the patient. (During use the rescuer may need to release the belt and re-secure the belt around the patient without replacing the cartridge.) Since the belt maintains the same length, the chest compression device is much more likely to achieve the same depth of chest compressions after the belt has been re-secured as compared to before the belt has been re-secured.

The combination of hook and loop fasteners and the eyelet/peg fastener provides for a means for securing the belt around the patient. The same combination allows a rescuer to rapidly and easily release the belt. The rescuer may release the belt, even during compressions, by grasping the left end of the belt and lifting the left load distribution section from the right load distribution section. Thus, the securing mechanism is also an emergency release mechanism. To further enhance safety, the eyelet may be provided with an electrical contact switch, optical sensor or other electrical or mechanical means for determining whether the peg is inserted into the eyelet. Thus, a chest compression device with the appropriate software or hardware can sense whether the peg is fully inserted into the eyelet. If the peg is not in the eyelet, then the chest compression device will not perform compressions. The system will alert the operator if proper registration is not detected so that the operator may re-fit the belt.

Figure 2:
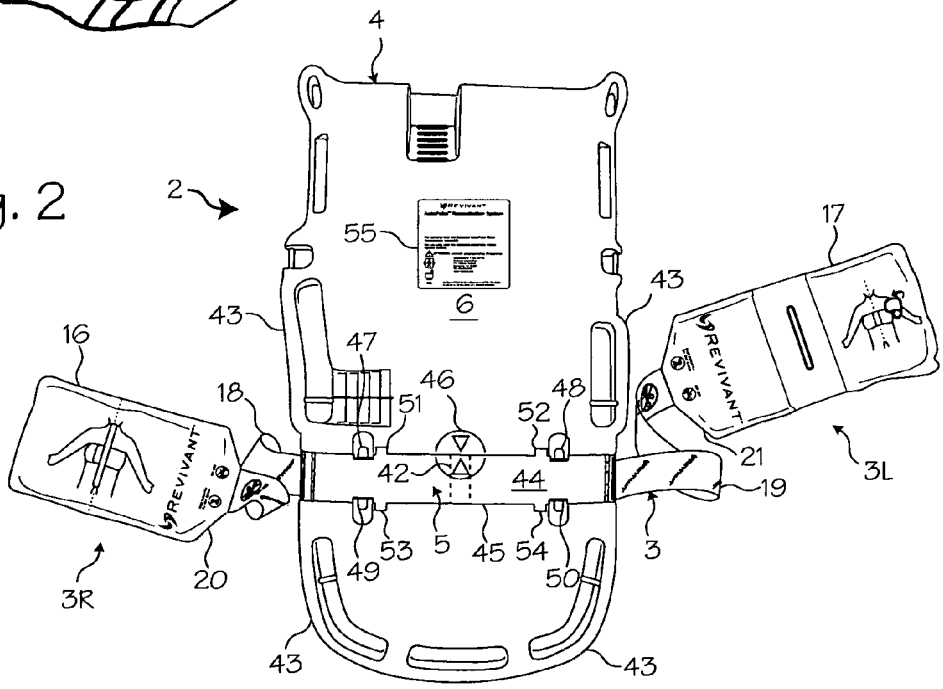
FIG. 2 shows a bottom view of a chest compression device that uses a belt to perform compressions.

FIG. 2 shows a bottom view of the belt drive platform 4 and shows the housing 6, a belt cartridge 5 attached to the housing and a means for tightening the belt disposed within the belt drive platform. The means for tightening the belt may comprise a drive spool 42 attached to the belt and to a motor. The drive spool is shown in phantom to indicate its position beneath the cover plate. The motor and associated components are located within the belt drive platform.

The belt drive platform is provided with a control system that controls how the belt is wrapped around the drive spool. For example, the drive spool is controlled so that some of the belt is left wrapped around the drive spool between compressions. When the means for tightening has loosened the belt around the patient, just before beginning the next compression, a length of the belt corresponding to one revolution of the drive spool is left wrapped around the drive spool. Thus, the belt will maintain its curled shape, reducing the chance of causing folds in the belt during compressions and increasing the efficiency of spooling the belt around the drive spool.

The housing serves as a support for the patient. Handles 43 provide for easy transport of the housing and of the patient while on the housing. The belt cartridge has a cover plate 44 that fits within a channel beam 45 in the belt drive platform, thus securing the belt cartridge 41 to the belt drive platform 4. Labels 46 are placed on the housing and cover plate to indicate the proper alignment of the cover plate. The cover plate is secured to and aligned within the channel beam by the use of retainer clips or snap latches 47, 48, 49 and 50 which fit between corresponding paired bosses or detents in the housing. Tabs integrally formed with the snap latches extend into slots disposed in the housing of the belt drive platform. The cover plate is also aligned and secured within the channel beam by the use of hooks 51, 52, 53 and 54 which fit into corresponding apertures in the housing. In addition, the cover plate is also provided with additional labeling 55 to provide warnings, manufacturer information, trademarks or advertising.

Figure 3:
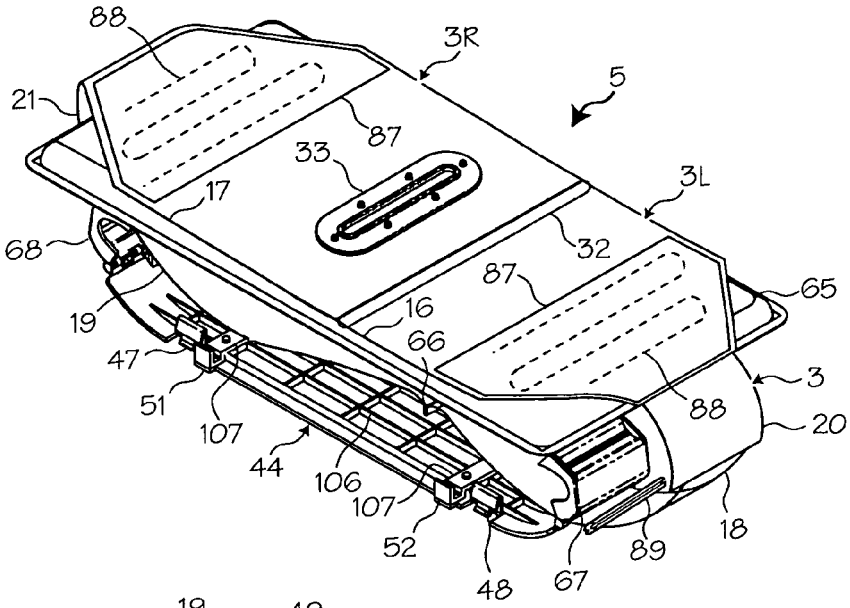
FIG. 3 shows a top (anterior) view of a belt cartridge used with a belt drive platform.
Figure 4:
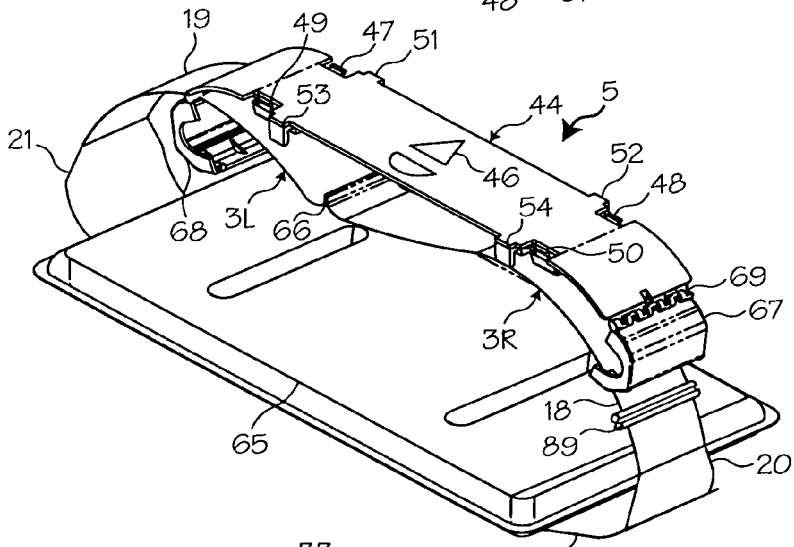
FIG. 4 shows a bottom (posterior) view of a belt cartridge used with the belt drive platform.
Figure 5:
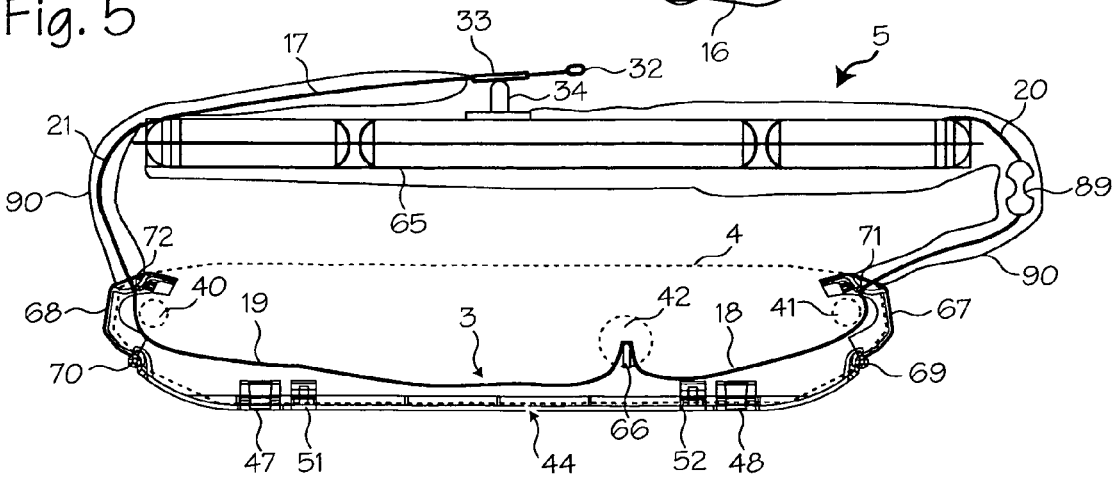
FIG. 5 shows a superior view of a belt cartridge used with the belt drive platform.

FIGS. 3, 4 and 5 show the belt cartridge 41. The belt cartridge is disposable so that there is no need to clean the belt, or other elements of the cartridge, after use. Thus, the belt cartridge reduces the exposure of subsequent patients and users to bodily fluids or other contaminants. If necessary, the cartridge may be replaced while the patient is still on the belt drive platform. In addition, since the belt cartridge is disposable the belt may be made of materials that readily conform to the shape of an individual patient, but have a shorter service life.

The cartridge includes a belt 3, a compression pad 65 attached to the belt, a belt clip, key or spline 66 for attaching the belt to a drive spool, a cover plate 44 and belt guards 67 and 68 rotatably attached to the cover plate via hinges 69 and 70. The belt guards are removably secured over left and right spindles, 40 and 41 respectively, that are attached to the belt drive platform. A liner, sleeve or sock is disposed over the belt, as shown in FIG. 5. The belt is threaded through slots 71 and 72 disposed in the belt guards 67 and 68. With regard to the belt 3, the right portion 3R and the left portion 3L of the belt share pull straps 18 and 19 and each have a load distribution section 16 and 17 and a transition section 20 and 21. Each load distribution section of the belt is provided with hook and loop fasteners so that the belt may be secured around the patient's chest. Additionally, as described above, an eyelet 33 is provided in the left load distribution section and a corresponding peg 34 is provided in the right load distribution section (see FIG. 5). Preferably, the pull strap sections comprise a single strap.

The pull straps of the belt are secured to the drive spool of the belt drive platform with the spline 66, which is attached to the pull straps of the belt. The spline fits within a slot provided in the drive spool. When the drive spool rotates, the pull straps spool around the drive spool. The compression belt then tightens and is pulled onto the patient's chest, thereby accomplishing compressions.

The pull straps 18 and 19 of the belt are threaded through the belt guards 67 and 68 which are rotatably attached to the cover plate 44. The belt guards and cover plate are fashioned from a lightweight but strong plastic. The cover plate and belt guards are designed to allow the belt cartridge to be removably attached to the belt drive platform and to protect the belt during use. Specifically, the cover plate is provided with snap latches 47, 48, 49 and 50 that fit between corresponding paired bosses or detents on the housing. Integral tabs extend from the snap latches and fit into corresponding slots in the housing. The cover plate is also provided with hooks 51, 52, 53 and 54 that fit into corresponding apertures in the housing of the belt drive platform. The snap latches and hooks are designed so that the cover plate is removably attached to the belt drive platform without the use of tools. The snap latches and hooks may have a variety of shapes and forms. The snap latches and hooks may also be asymmetrical with respect to the cover plate, thus making it possible to fit the cover plate on the belt drive platform in only one orientation. To increase the ease of use of the cartridge, the cover plate is provided with labels 46 to indicate the desired orientation of the cover plate with respect to the belt drive platform.

Below the load distribution sections of the belt is a compression pad 65 that affects the distribution of compression force and assists in performing chest compressions. An example of a chest compression pad may be found in our application Ser. No. 10/192,771, filed Jul. 10, 2002. In one embodiment the compression pad is a three-sectioned bladder filled with foam. The compression pad is located on the belt so that it is centered over the patient's chest when the belt is in use. The compression pad is disposed below the load distribution sections of the belt and is removably attached to the belt with double-stick tape, hook and loop fasteners or comparable fastening means. The compression pad is also disposed inside the liner sock.

Additional safety features may be provided with the compression belt cartridge 41. For example, spreader bars or reinforcing plates 87 may be attached to the transition sections of the belt with stitches 88. (The reinforcing plates may be attached to the transition sections of the belt by any suitable method.) The reinforcing plates reinforce the transition sections of the belt and help prevent the transition and load distribution sections from twisting, bending, folding or otherwise deforming with respect to the pull straps, except in regard to the ability of the belt to wrap around the patient's chest. The reinforcing plates are made of a hard, though flexible plastic or other suitable material.

The belt also may be provided with one or more breakable couplings or breakable links 89 on one or both sides of the load distribution or belt transition sections. The breakable link 89 or links are interposed between sequential portions of the belt such that the belt separates if a link breaks. The link is designed to break at a predetermined tension. If the belt experiences an unsafe amount of tension, then a link breaks, the belt separates and the patient is thereby protected from excessive forces. What constitutes an unsafe amount of tension or excessive force varies, depending on the patient and the device and belt used, but is in the range of about 200 pounds to about 500 pounds as measured in the area of the belt to the side of the patient. Preferably, the link is designed to break under about 300 pounds of tension as measured in the area of the belt to the side of the patient. In addition, the link may be designed to reattach to itself or to a clip or other mating fastener after failure. Thus, in the event of link failure, the belt may be re-attached quickly and compressions may be restarted with minimal delay.

To prevent the load distribution sections from twisting relative to the other sections of the belt, the links may be designed to also serve as swivel joints, or the belt may be provided with additional swivel joints along the belt. The swivel joints connect the pull straps to the belt transition sections. The swivel joints allow the load distribution sections to twist relative to the pull straps, about the longitudinal axis of the belt, without twisting the pull straps themselves.

Another safety feature is a liner sock 90 for the belt (see FIG. 5). The liner sock surrounds the portions of the pull straps, as well as the compression pad, that contact the patient thereby protecting the patient from friction as the belt moves during compressions. The liner socks are attached to the belt guards around the belt guard slots so that hair, other body parts or other foreign objects cannot become caught in the belt guard slots. On the other end, the socks are disposed around and are attached to the load distribution sections of the belt.

In use, the belt spline is inserted into the drive spool of the belt drive platform. The cover plate of the cartridge is then inserted into the channel beam of the belt drive platform and fixed into place via the hooks and snap latches. The belt is wrapped around the patient, with the load distribution sections secured over the patient's chest. Thus, the chest compression device performs compressions by repetitively tightening the belt.

Figure 6A:
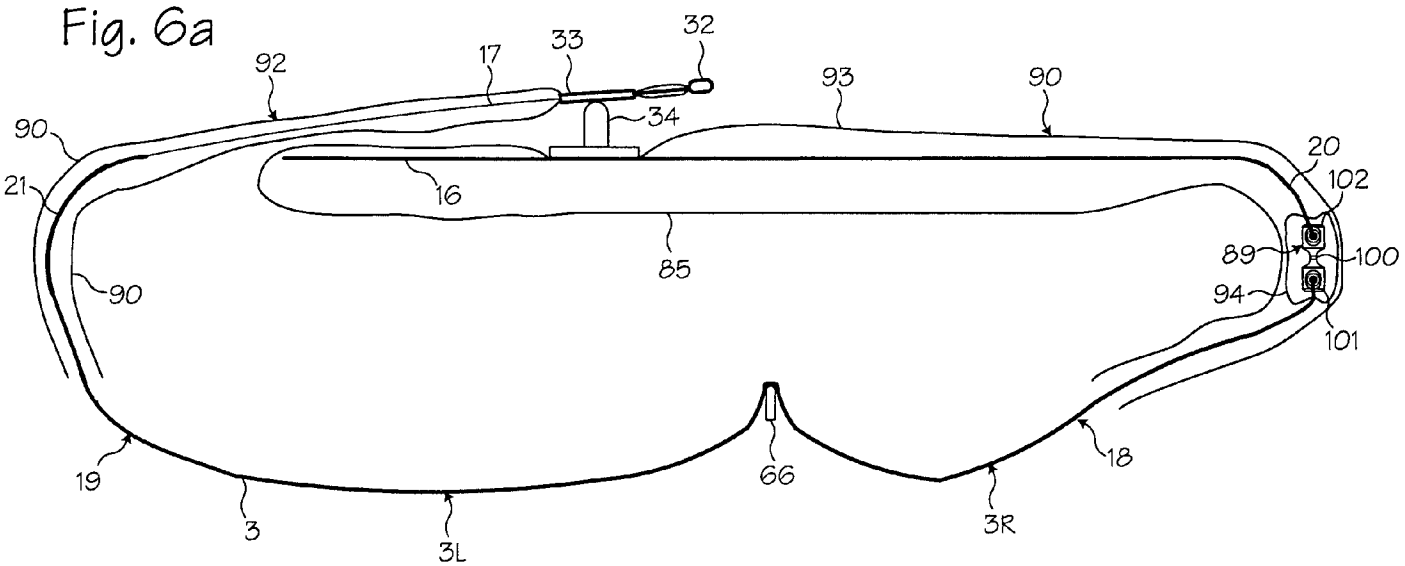
FIG. 6*a* shows a cross-section of the belt, liner socks and breakable link.
Figure 6B:
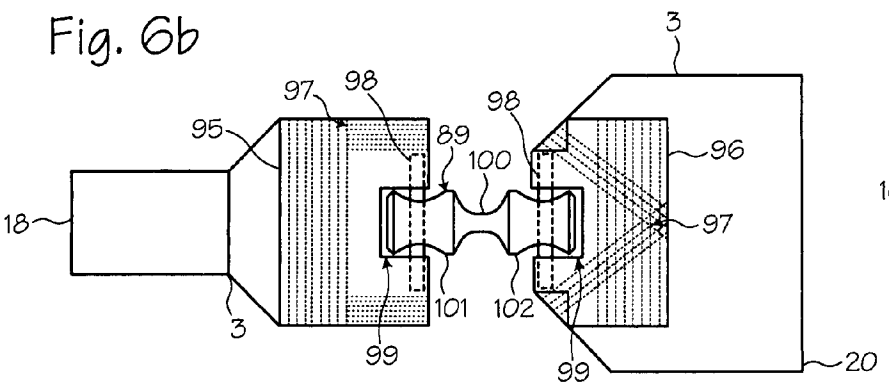
FIG. 6*b* shows the belt attached to the breakable link.
Figure 6C:
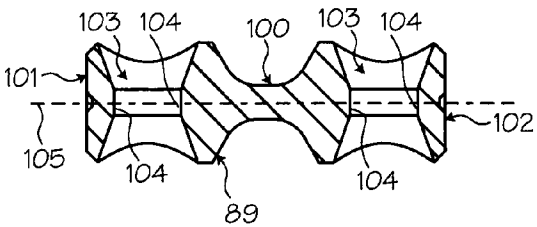
FIG. 6*c* shows another cross-section of the breakable link.

FIGS. 6*a* through 6*c* show close-up views of the belt 3, the breakable link 89 and the liner socks 92 and 93 surrounding the portions 3R and 3L of the belt that contact the patient and also shows the breakable link 89. (The peg 34, eyelet 33, spline 66 and various sections of the belt 16, 17, Error! Bookmark not defined, 19, 20 and 21 are shown for reference. The compression pad and cover plate are not shown in order to more clearly show the belt liner.) The loosely fitted liner socks protect the patient from friction. The belt generates friction along the surface of the patient as the belt repetitively compresses the patient's chest. Without some means for reducing the friction, the belt would likely cause injury during compressions, such as abrasions, contusions or other compression-related injuries. In addition, friction increases the energy required to operate the compression device and thereby reduces battery life. The liner socks protect the patient and increase energy efficiency by allowing the belt to easily slide along the liner, with the liner only moving slightly against the patient's chest. (Some bunching of the liner socks may occur during compressions.)

The liner socks are tubes of Tyvek™ (high-density, spun bonded polyethylene) that are attached to the belt cartridge to form socks around the right 73 and left 3L portions of the belt. (The liner socks may comprise other materials that are water resistant and have a similar coefficient of friction to Tyvek™, Teflon™ or like substances. The liner socks may also have multiple layers of material; that is, socks within socks.) The left sock 92 is attached to the left belt guard 68 at one end and to the left load distribution section 17 of the belt at the other end. A hole in the left sock allows the peg 34 to be inserted into the eyelet 33. The left sock is attached to the belt at any point near the free end of the load distribution section. The right sock 93 is attached to the right belt guard 67 at one end and to the right load distribution section 16 of the belt at the other end. The right sock is attached to the belt at any point near the free end of the right load distribution section. The right sock wraps around the compression pad 65 and surrounds the breakable link.

The breakable link 89 is a cylinder made of aluminum or other suitable material. The central portion 100 of the cylinder has a smaller diameter than the end portions 101 and 102 of the cylinder. Since the link will break at the thinnest portion of the cylinder, the amount of force required to break the link is precisely controlled by setting the radius of the central portion 100 of the cylinder. If the link 89 breaks under tension then the two remaining ends of the link remain within the sock. The liner sock thus reduces the chance that a broken link will lash out and cause injury to the patient or bystanders. In addition, a separate bag or sleeve 94 may be attached to the belt near either end of the link. The bag surrounds the breakable link and contains the link in the event that the link breaks.

The link or links attached to the belt may be provided with additional features. For example, a link may be additionally designed to serve as a swivel joint. The swivel joint link connects the pull straps to the belt transition sections of the belt. The swivel joint link allows the load distribution sections to twist relative to the pull straps, about the longitudinal axis of the belt, without twisting the pull straps themselves. (The pull straps are sufficiently stiff that they do not twist during use.) The swivel joint link helps prevent the device from malfunctioning as a result of the pull straps becoming twisted and helps prevent the link from breaking due to shear forces or twisting forces. In other devices, separate swivel joints are provided and attached to the belt as described above. For these devices the swivel joint and the link may be connected to each other, but may also be disposed at separate locations on the belt.

In addition, a link or swivel link may be designed to be re-engaged (or to be re-attached to the belt) if one or more links do separate. For example, the link or swivel link may be attached to the belt with a clip that fails at a pre-determined force, but that can be re-attached to the belt. Similarly, the swivel link may be provided in two pieces joined by a joint that separates at a pre-determined force, but that can be re-attached to each other. (Other re-attachable links or swivel link designs may also be used.) Thus, in the event of a link failure during chest compressions, the entire belt cartridge need not be replaced. Instead, the problem that caused the failure can be addressed, the failed link or links quickly re-engaged or re-attached and chest compressions then resumed. The re-attached link will fail at the same force as the force required to cause the link to originally fail.

The detachable link may comprise a detachable device operably connected to a force sensor, pressure sensor or strain gauge. The detachable device is highly resistant to breaking under force, but the detachable device will separate when the force sensor, pressure sensor or strain gauge measures an excessive force. Such a detachable device may be designed so that a user may reattach the link to itself or to the belt, thereby allowing the user to restart compressions quickly.

FIG. 6*b* shows the belt 3 attached to the breakable link 89. The breakable link is located on the belt in a place where the belt tension most closely corresponds to the actual load on the patient. Thus, the breakable link 89 is located between the pull straps and the transition-section of the belt. The breakable link may be located elsewhere on the belt, though the link would have to be adjusted to break at a different amount of belt tension since the tension and sheer forces on the link would be different. Multiple links may be provided on either side of the belt. Preferably, one link is provided on each side of the belt relative to the patient.

The link is designed to break in the presence of excessive tension (over about 200 pounds to about 500 pounds on one side of the patient, and preferably at about 300 pounds). The breakable link breaks cleanly under excessive tension and experiences little plastic deformation before breaking. Thus, if the belt experiences excessive tension, the link will break, the belt will separate and the patient will be protected from excessive forces.

To attach the link to the belt, the belt is separated into two sections and corresponding flaps 95 and 96 near opposing ends of each section are folded over themselves to form pockets in each belt section. The pockets are held in place by stitches 97. A pin 98 is disposed within each pocket and held in place by the stitches. The pins are exposed in the area of holes 99 that are provided in a corresponding end of each pocket. The holes provide space to receive the ends of the link and allow the pins to be threaded through apertures provided in the link. (The unexposed portions of the pins are shown in phantom to indicate their position inside the pockets and inside the link.) Thus, a pin connects a section of the belt to the link and the belt sections are thereby connected to each other via the link. The link is designed so that the center of the link will break, thereby separating the belt, before the pins or any other part of the link will break.

FIG. 6*c* shows another cross-section of the breakable link. The breakable link 89 is an aluminum cylinder. The central portion 100 of the cylinder has a smaller diameter than the end portions 101 and 102 of the cylinder. Since the link will break at the thinnest portion of the cylinder, the amount of force required to break the link is precisely controlled by setting the cross-sectional area of the smallest part of the central portion 100 of the cylinder. The material used to make the link also controls the force required to break the link. Different materials will break at different levels of force depending on a number of factors, including the cross sectional area of the link, the type of alloy used, whether the link is heat treated, the type of surface finish provided and the like.

Each end portion of the cylinder is provided with a hole 103 to accommodate the pins. The holes are drilled from either side of the cylinder with a conical drill. The conical drill creates opposing ridges 104 in the center of each hole. A pin contacts the link in the area of the ridges so that the pin is loaded at a point. This orientation prevents excessive forces from developing in directions other than in the direction the link is intended to break. The combination of the conical holes and the pins permit the link to bend or break only in the direction the link is intended to break. To further reduce bending or shear forces, the pins and/or the link are coated with Teflon™ (polytetrafluoroethylene) so that the pins may wobble with minimal friction within the link holes.

The breakable link has a length of 0.942 inches, has a radius of 0.310 inches at the end portions and a radius of 0.088 inches at the thinnest central portion. The end portions of the link are 0.310 inches long each and the central portion of the link is 0.322 inches long. The thinnest central portion of the link is 0.042 inches long (and is part of the overall 0.322 inch length of the central section). An aluminum link of these dimensions will break when about 300 pounds of force is applied along the long axis 105 of the link. The dimensions of the link may be varied to vary the force required to break the link, preferably about 300 pounds for the detachable device and belt cartridge shown in FIGS. 3 through 5. In addition to aluminum, the link may be made of a variety of materials, including other metals (such as steel or magnesium), polymers, composites or fibers. However, the link must predictably break when exposed to a given force applied in a given direction.

Figure 7:
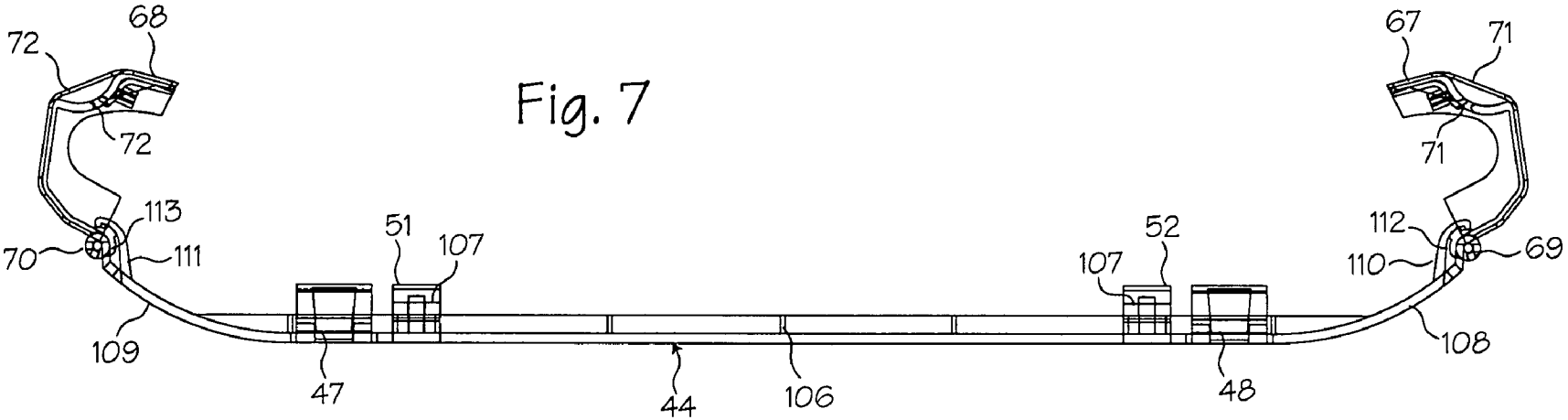
FIG. 7 shows a close-up view of the cover plate used in the belt cartridge of FIGS. 3 through 5.

FIG. 7 shows a close-up view of the cover plate 44 used in the belt cartridge of FIGS. 3 through 5. As already described, the cover plate is designed to allow the belt cartridge to be removably attached to the belt drive platform and to protect the belt during use. Specifically, the cover plate is provided with hooks 51 and 52 that fit within apertures provided in the housing or belt drive platform. The cover plate is also provided with snap latches 47 and 48 which fit securely between corresponding paired bosses or detents that extend from the edges of slots disposed in the housing or belt drive platform. Tabs integrally formed with the snap latches extend into the slots when the cover plate is secured to the housing or belt drive platform.

To reduce weight, the cover plate is fashioned from a thin plate of plastic. To increase strength, the cover plate is provided with intersecting reinforcing bars 106 (also shown in FIG. 3) that reinforce the cover plate and help the cover plate to resist the force of compressions. Additional aluminum reinforcement braces 107 (also shown in FIG. 3) are provided to further reinforce the cover plate. The reinforcement braces connect the hooks to each other to provide the cover plate with additional strength. The reinforcement braces also brace the channel beam, thereby protecting the belt drive platform from deforming under high forces.

The cover plate is provided with opposing curved extensions 108 and 109 so that the cover plate fits precisely within the belt drive platform. The curved extensions, as well as the overall size and dimensions of the cover plate, prevent the belt cartridge from being used with belt drive platforms not designed to receive the belt cartridge. Thus, the cover plate also helps ensure that the cartridge will be used safely.

Rotatably attached to the curved extensions of the cover plate are belt guards 67 and 68 that protect the user, belt drive platform and belt when the chest compression device is in use. The belt guards are removably disposed around spindles 40 and 41 during use. The belt guards are wider than the pull straps, and the pull straps are threaded through slots 71 and 72 disposed in the belt guards. Thus, during use, the belt slides within the belt guards and over the spindles. Spindles 40 and 41, in turn, rotate within the belt drive platform. The spindles also rotate underneath the belt guards, sliding against the belt guards where the belt guards are disposed against the spindles.

On each end of the cover plate 44 fingers or pawls 110 and 111 hook around corresponding catches or ratchets 112 and 113. The ratchets are attached to the corresponding hinges 69 and 70, though may be attached to the corresponding belt guards. The pawls are attached to the cover plate and prevent the belt guards from curling outwardly towards the cover plate. However, a user may apply a force sufficient to pull the ratchets away from the pawls as the hinges rotate, thereby allowing belt guards more freedom to rotate outwardly, away from the cover plate. The user may also re-engage the pawl and ratchet so that the belt guards are once again prevented from curling outwardly.

Other devices and methods may also be used to increase the safety of using a belt to perform chest compressions. For example, other forms of reducing the coefficient of friction of the belt may be used. The liner, belt or patient may be provided with a layer of friction-reducing material. For example, a layer of Teflon™ may be placed between the belt and the liner sock, between the belt and the compression pad or between the belt and the patient. (The layer of friction-reducing material decreases the chance that the patient will be injured during chest compressions and increases the energy efficiency of chest compressions.) Thus, one or more liner sheets can replace or be used in addition to the liner socks to prevent injury to the patient. The coefficient of friction of the belt may also be reduced by super-cooling the belt. A lubricating substance, such as talc powder or a liquid may placed between the patient and the belt, but means for preventing the lubricant from entering the belt drive platform should also be provided.

Additionally, the belt and belt cartridge may be provided in different sizes to accommodate differently sized patients. The belt and belt cartridge described herein is sized to accommodate about 95% of the population. Thus, if one smaller belt size and one larger belt size are available, then the three belt sizes will accommodate the vast majority of all patient sizes (though a range of belt sizes is possible). Another design scheme uses one size of belt and cartridge and provides detachable belt extensions to increase the size of the belt. A belt extension is a length of belt having similar properties to the belt on the cartridge. A suitable fastener, such as a hook and loop fastener or a detachable link, connects the belt extension to the belt on the cartridge.

When multiple belt sizes are available the belt may be provided with markings that allow the rescuer to measure the length of the belt with respect to the patient. The user then manually enters the size of the belt into the belt drive platform through a user interface in the belt drive platform. To accommodate the new belt size the device's software alters how the device performs chest compressions. Thus, the device will perform chest compressions consistent with medical guidelines, regardless of the size of the belt or the size of the patient (to the design limits of the device).

In other devices, the belt cartridge is provided with an identifying code, pinout or other identifier that automatically inputs the size of the belt into the belt drive platform. The device changes how it performs chest compressions (in terms of how much belt slack is taken up by the means for tightening) based on the size of the belt. In the case of belt extensions, the new belt length is manually entered into the processor, though the belt extension may be provided with a switch or other identifying mechanism that automatically inputs the new overall belt length into the processor. Again, the belt drive platform's software accordingly alters how the device performs chest compressions.

In addition, other means for tightening the belt may be used to drive the belt, such as multiple motors and drive spools, pistons, scissors mechanisms or other mechanical actuators. Moreover, the belt drive platforms or housings containing such means may have a variety of shapes and sizes, so long as the belt and belt cartridge are designed to attach to a particular belt drive platform and to means for tightening the belt. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A system for performing chest compressions on a patient, said system comprising:
- a housing;
- a drive spool operably attached to the housing;
- a means for rotating the drive spool, said means for rotating disposed within the housing and operably attached to the drive spool;
- a compression belt cartridge comprising:
  - a belt attached to the drive spool, the belt suitable for compressing the chest of the patient; and
  - a breakable link attached to the belt, said breakable link sized and dimensioned to break when a particular amount of force is applied to the link, and wherein the breakable link is attached to the belt such that if the breakable link breaks, the belt will separate.

2. The system of claim 1 further comprising a compression pad attached to the belt.

3. The system of claim 1 further comprising:
- a first spindle rotatably attached to the housing;
- a second spindle rotatably attached to the housing;
- wherein the the belt is removably attachable to the drive spool; and the compression belt cartridge further comprises:
  - a first belt guard removably attached to the first spindle and operably attached to the belt such that the belt may slide through the first belt guard; and
  - a second belt guard removably attached to the second spindle and operably attached to the belt such that the belt may slide through the second belt guard.

4. The system of claim 3 further comprising a compression pad attached to the belt.

5. The system of claim 3 wherein:
- the compression belt cartridge further comprises a cover plate removably attached to the housing; and
- the first belt guard is operably attached to the cover plate and the second belt guard is operably attached to the cover plate opposite the first belt guard.

6. The system of claim 5 further comprises:
- a first hinge rotatably connecting the second belt guard to the cover plate;
- a second hinge rotatably connecting the second belt guard to the cover plate.

7. The system of claim 6 further comprising:
- a first ratchet attached to the first belt guard and a first pawl attached to the cover plate, said first pawl operatively engaging the first ratchet; and
- a second ratchet attached to the second belt guard and a second pawl attached to the cover plate, said second pawl operatively engaging the second ratchet.

8. The system of claim 3 wherein the belt further comprises:
- a first portion and a second portion; and the compression belt further comprises:
- a cover plate removably attachable to the housing;
- wherein the first belt guard is operably attached to the cover plate;
- wherein the second belt guard is operably attached to the cover plate opposite the first belt guard;
- a first liner sock loosely fitted over the first portion of the belt, said first liner sock attached to the first portion of the belt and attached to the first belt guard;
- a second liner sock loosely fitted over the second portion of the belt, said second liner sock attached to the second portion of the belt and attached to the second belt guard;
- a compression pad attached to the first portion of the belt and disposed within the first liner sock.

9. The system of claim 8 further comprising:
- a first hinge rotatably connecting the first belt guard to the cover plate; and
- a second hinge rotatably connecting the second belt guard to the cover plate.

10. The system of claim 8 further comprising:
- a first ratchet attached to the first belt guard and a first pawl attached to the cover plate, said first pawl operatively engaging the first ratchet; and
- a second ratchet attached to the second belt guard and a second pawl attached to the cover plate, said second pawl operatively engaging the second ratchet.

11. The system of claim 8 wherein the breakable link is disposed inside the first liner sock.

12. The system of claim 8 wherein the breakable link is disposed inside a sleeve attached to the belt.

13. The system of claim 12 wherein the breakable link is disposed inside a sleeve, said sleeve attached to the belt and disposed inside the first liner sock.

14. The system of claim 8 wherein the first belt guard is provided with a first belt slot and the second belt guard is provided with a second belt slot, wherein the belt is threaded through the first belt slot and through the second belt slot.

* * * * *